US006291753B1

(12) United States Patent
Campbell et al.

(10) Patent No.: US 6,291,753 B1
(45) Date of Patent: Sep. 18, 2001

(54) MARCHING SNARE DRUMHEAD PATCH

(75) Inventors: James Campbell, Lexington, KY (US); Thomas Hannum, Hadley, MA (US); Michael Robinson, Dix Hills, NY (US)

(73) Assignee: J. D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 09/524,955

(22) Filed: Feb. 22, 2000

(51) Int. Cl.[7] ..... G10D 13/02
(52) U.S. Cl. ..... 84/411 M; 84/402; 84/411 P
(58) Field of Search ..... 84/411 M, 411 R, 84/411 P, 414, 453, 402

(56) References Cited

U.S. PATENT DOCUMENTS 1,495,672 * 5/1924 Cheney ..... 84/411 R
2,536,460 * 1/1951 Paarecamp ..... 116/1
4,056,999 * 11/1977 Bennett ..... 84/479
4,362,080 * 12/1982 DeArmas ..... 84/406
4,936,410 * 6/1990 Howell ..... 181/148
4,951,541 * 8/1990 McMillan ..... 84/280
5,864,083 * 1/1999 Caren ..... 84/737
5,986,196 * 11/1999 Behrenfeld ..... 84/411 M
5,998,716 * 12/1999 Marquez et al. ..... 84/411 P

* cited by examiner

*Primary Examiner*—Shih-Yung Hsieh
(74) *Attorney, Agent, or Firm*—Alix, Yale & Ristas, LLP

(57) ABSTRACT

A drumhead patch particularly adapted for use on snare drums used in marching bands consists of a plastic layer adhered to a section of the playing surface of the snare drumhead membrane. A first portion of the patch defines a series of openings while a second portion has no openings. The patch alters the vibration characteristics of the membrane and presents alternative playing surfaces to the musician. A guiro effect is produced by dragging a drumstick over the openings in the first portion of the patch. The second portion produces distinctly different impact sounds than the playing surface of the drumhead membrane when struck by a beater. The patch may be positioned on the playing surface to meet the needs of a particular musician.

22 Claims, 3 Drawing Sheets

MARCHING SNARE DRUMHEAD PATCH

BACKGROUND OF THE INVENTION

The present invention relates to musical instruments of the type classified as percussion instruments such as drums which are used in bands. More particularly, the invention relates to a sound altering patch for use on the playing surface of a drum.

Drums typically have a cylindrical drum shell with a membrane held in tension over at least one end of the shell. The membrane emits sound-producing vibrations when the outwardly facing, or playing surface of the membrane is struck with a drumstick, mallet or other beater. Many drums, such as snare and tom tom drums, are struck with hard sticks or mallets, producing a very sharp impact sound. The playing surfaces of such drums usually have uniform characteristics and produce a similar impact sound wherever the beater strikes the playing surface.

SUMMARY OF THE INVENTION

Briefly stated, the invention in a preferred form is a layer of plastic material adhesively bonded to the playing surface of a drumhead membrane to provide the musician with additional playing surfaces, each inducing different sound producing vibrations of the drumhead membrane when impacted by a beater.

In one embodiment, the invention takes the form of an adhesive backed, semi-circular plastic patch. One half of the patch has a series of equal-width, equally spaced diagonal slots while the other half has none. The patch functions to alter the vibrations of the drumhead membrane, and thus the sounds emitted by the drum in several ways. The addition of a layer to one portion of the membrane will remove some of the overtones usually produced by the drumhead membrane, decreasing sustain and maximizing articulation. In addition, when the solid portion of the patch is struck by a beater, the impact sound produced will be distinctly different from that produced by the playing surface of the drumhead membrane. The slotted portion of the patch gives the musician the opportunity to drag a beater over the slots, producing a sound similar to a percussion instrument known as a Guiro. Additionally, the patch will raise the fundamental pitch of the drumhead membrane wherever the patch is placed on the membrane.

A preferred form of the drumhead patch is constructed from a sheet of polycarbonate plastic having a thickness of about 10 to 20 mils laminated with a pressure sensitive adhesive layer of about 1 to 3 mils in thickness. The non-adhesive surface of the polycarbonate sheet preferably has what is known in the art as a velvet, or semi-matte surface texture. The laminate is then die or laser cut to shape. In general, the patch material should present a playing surface to the musician that will produce a different impact sound than the playing surface of the drumhead membrane.

The polycarbonate embodiment of the drumhead patch presents a harder playing surface to the musician than the playing surface of the drumhead membrane, producing a sharp impact sound when the drum is struck on the playing surface of the patch. The drumhead patch may be placed anywhere on the playing surface of a drum to produce a personalized instrument, suited to the particular needs or style of the musician.

An object of the invention is to provide a new and improved drumhead patch which adds playing areas to the previously uniform playing surface of a drumhead membrane, each additional playing area producing a different sound when impacted by a beater.

Another object of the invention is to provide a new and improved drumhead patch, which may be applied to the playing surface of a drumhead membrane to alter the vibration characteristics of the membrane.

A further object of the invention is to provide a new and improved drumhead patch which may be applied to the playing surface of a drumhead membrane to allow the production of a guiro sound effect by dragging a drumstick over slots formed in the patch.

A yet further object of the invention is to provide a new and improved drumhead patch which may be positioned by the musician to create a customized percussion instrument playing surface.

These and other objects, features and advantages of the invention will become readily apparent to those skilled in the art upon reading the description of the preferred embodiments, in conjunction with the accompanying drawings.

DETAILED DESCRIPTION OF THE PREFERRED EMBODIMENTS

Figure 1:
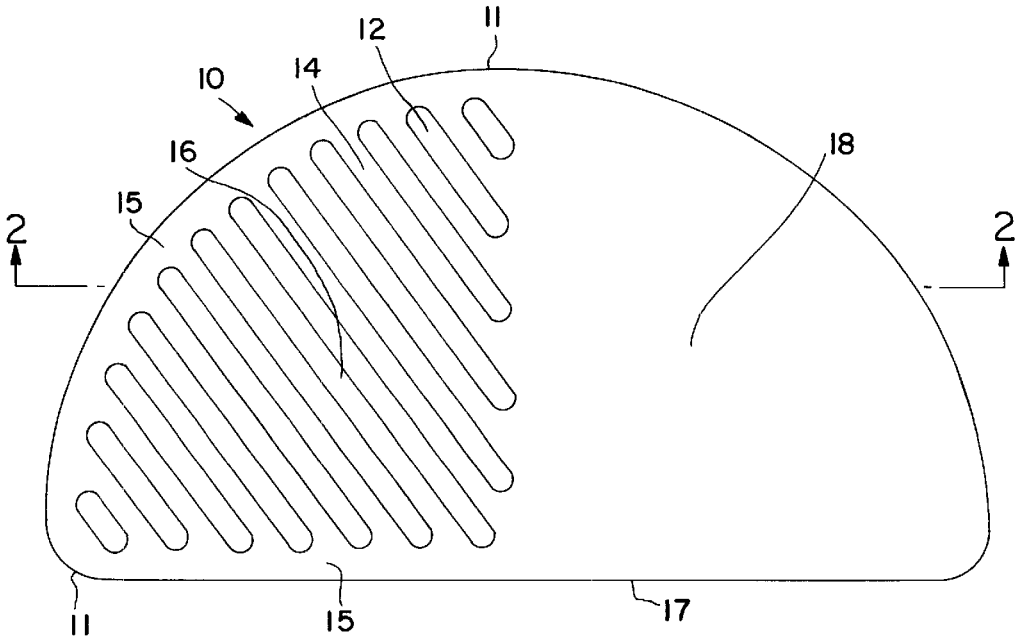
FIG. 1 is a top plan view of a drumhead patch in accordance with the present invention.

FIG. 1 illustrates a marching snare drumhead patch 10 in accordance with the present invention. The patch 10 preferably consists of a semi-circular sheet of plastic material, which is divided into two generally equal portions. A first portion 16 defines a series of equal width, equally spaced diagonal slots 12. A second portion 18 is continuous, having no openings.

In the illustrated preferred embodiment, the slots 12 begin and end a short distance from the edge 11 of the patch 10, leaving a border 15 of plastic material around the slotted first portion 16. The slots 12 have a diagonal orientation to the diameter 17 of the semi-circular patch 10. The slots 12 have a length, measured along their diagonal extent, which is greater than their width, as measured perpendicular to their length. The slots 12 are separated from each other by a strip 14 of plastic material whose width is also measured perpendicular to the length of the slots 12.

A preferred embodiment of the marching snare drumhead patch 10 consists of a semi-circular sheet of plastic material having a 7-inch diameter 17. The slots 12 are approximately 3/16 inch wide. The strips 14 of plastic material separating the slots 12 are approximately 1/8 inch wide. The border 15 of plastic material surrounding the slotted first portion 16 of the patch measures approximately 3/16 inch from the slots 12 to the edge 11 of the patch 10.

Figure 2:
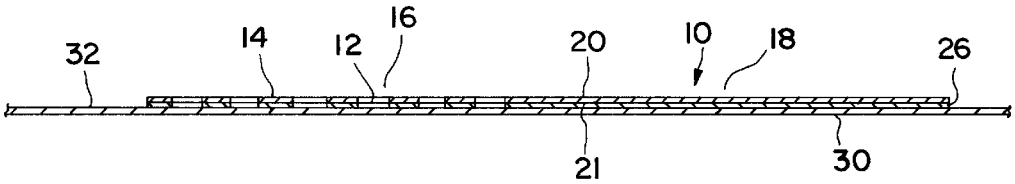
FIG. 2 is a cross sectional view of the drumhead patch of FIG. 1 taken along line 2—2, mounted to a drumhead membrane (partially illustrated)

The construction and use of the marching snare drumhead patch 10 may be best understood with reference to FIG. 2 in addition to FIG. 1. A preferred plastic material for the patch is a polycarbonate sheet approximately 15 mils in thickness. The sheet has a first surface 20, which will form the playing surfaces of the patch 10. The first surface 20 of the sheet material is manufactured to have a textured, semi-matte finish, known in the art as a velvet finish. The second surface 21 of the polycarbonate sheet is preferably laminated to a layer of pressure sensitive adhesive 26 having a thickness of approximately 2 mils. The adhesive layer is protected by a release liner (not illustrated). The laminated material is then die or laser cut to the desired shape having the desired configuration of openings.

FIG. 2 is a cross sectional view of a marching snare drumhead patch 10 installed on a drumhead membrane 30. The adhesive layer 26 of the patch 10 securely attaches the patch 10 to the playing surface 32 of the drumhead membrane 30. The playing surface 32 is exposed through the slots 12 in the first portion 16 of the patch 10. Strips of plastic material 14 separate the exposed portions of the playing surface 32 from each other. The pattern of slots 12 and strips 14 making up the first portion 16 of the patch 10 creates a playing surface which can be used to create a guiro percussion effect. To create a guiro effect, a drumstick is pressed against the slotted first portion 16 of the patch 10 and dragged over the slots 12 and strips 14.

The unslotted second portion 18 creates another playing surface, which can be struck by a beater in a conventional fashion. A beater impact on the second portion 18 will have a distinctly different sound than a similar impact on the playing surface 32 of the drumhead membrane 30. The different impact sound is the result of the differences in the materials used to manufacture the drumhead membrane 30 and the patch 10. Drumhead membranes are typically manufactured from sheets of synthetic material such as polyester or MYLAR®. In the case of marching snare drums, the drumhead membrane material is often reinforced with KEVLAR®. What all of these materials have in common is that they present a uniform playing surface to the musician. As a result, a beater impact anywhere on the uniform playing surface will create a similar impact sound and induce similar sound producing vibrations of the drumhead membrane. The polycarbonate playing surface presented to the musician by the second portion 18 of the patch 10 is harder than the materials customarily used to manufacture a drumhead membrane. A beater impact on this harder surface produces a sharper impact sound than a similar impact on the playing surface 32 of the drumhead membrane 30.

A marching snare drumhead patch 10 alters the sound characteristics of a drum in several ways. It is well known in the art that layers added to a drumhead membrane will alter the vibration characteristics, and thus the sound emitted by the membrane when struck. The marching snare drumhead patch 10 has a similar effect when applied to the playing surface 32 of a drumhead membrane 30. The patch 10 will remove some of the overtones emitted by the membrane 30, decreasing sustain and maximizing articulation.

The patch 10 also presents two playing surfaces to the musician in addition to the playing surface 32 of the drumhead membrane 30. The slotted first portion 16 of the patch 10 gives the musician the opportunity to create a guiro effect by dragging a drumstick over the pattern of slots 12 and strips 14. The solid second portion 18 of the patch presents a hard playing surface that emits a sharp impact sound when struck by a beater. Striking the second portion 18 of the patch or dragging a beater over the strips 14 and slots 12 of the first portion 16 of the will induce vibrations in the drumhead membrane 30 which result in sounds that are musically distinct from the vibrations induced by striking the playing surface 32 of the drumhead membrane 30.

Figure 3:
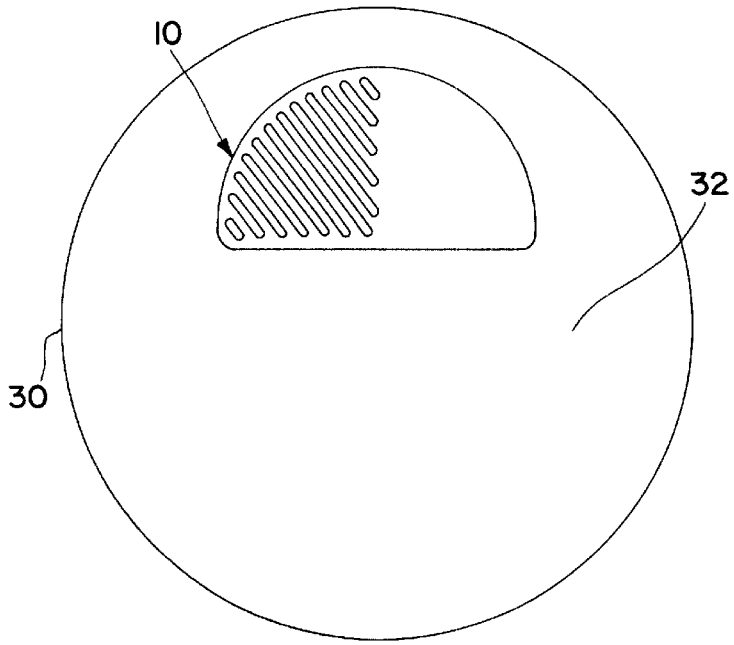
FIG. 3 is a top plan view of the drumhead patch of FIG. 1 mounted on the playing surface of a drumhead membrane.
Figure 4:
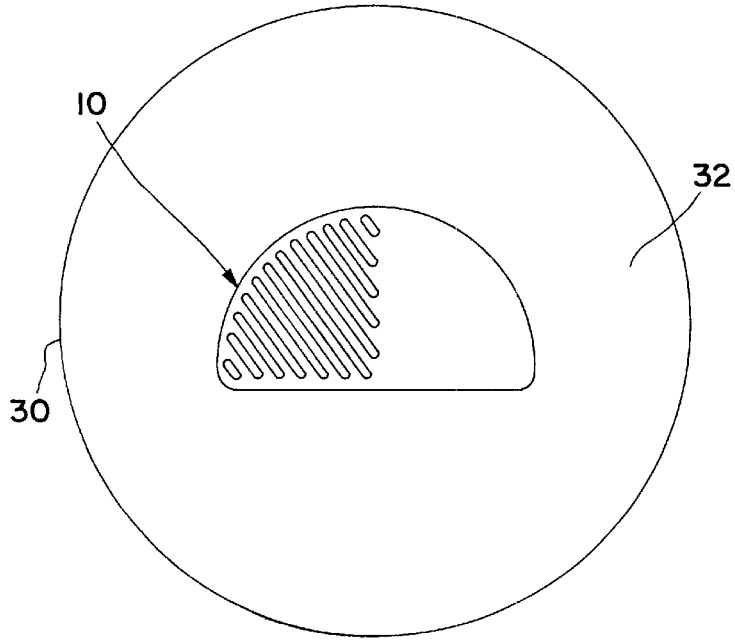
FIG. 4 is a top plan view of an alternative configuration of the drumhead patch of FIG. 1 mounted on the playing surface of a drumhead membrane.

A marching snare drumhead patch 10 may be placed anywhere on the playing surface 32 of a drumhead membrane 30. FIGS. 3 and 4 illustrate alternative positions for the patch 10. FIG. 3 illustrates an off-center positioning of the patch 10. An off-center position may be selected if the musician only occasionally uses the effects produced by either portion 16, 18 of the patch 10. A more central position, as illustrated in FIG. 4, may be chosen if the musician uses the effects more frequently. Selecting a personalized position for the patch 10 allows the musician to customize what would ordinarily be a uniform playing surface 32.

It should be understood that, while preferred materials and configurations have been illustrated for the marching snare drumhead patch, many materials and configurations might be selected. The size and shape of the openings, the number of alternative sound producing regions, and the pattern of openings described are a subset of many that might be used without departing from the spirit of the invention. In general, a drumhead patch in accordance with the present invention will be configured to occupy approximately 20% of the playing surface of a drumhead membrane.

Figure 5:
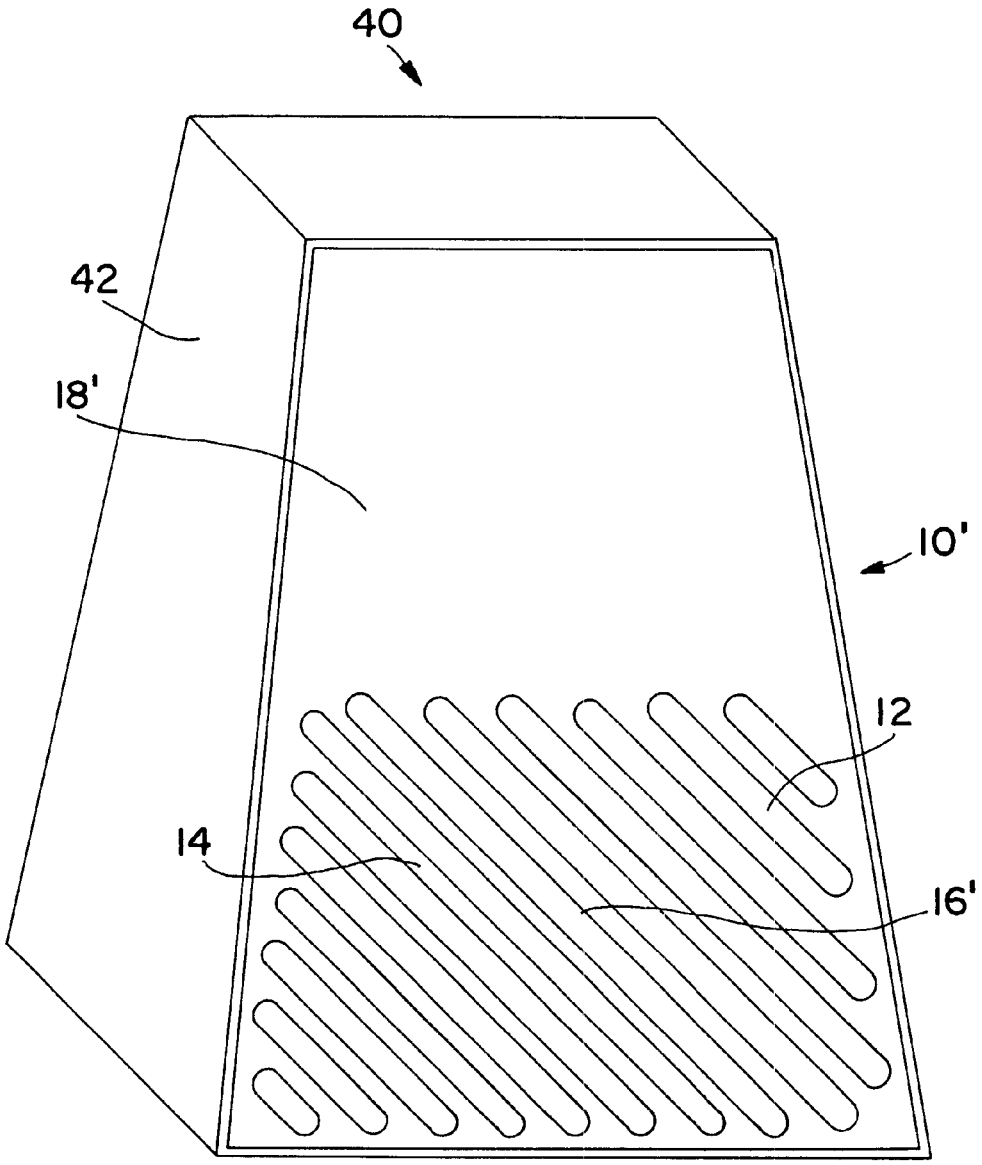
FIG. 5 is a perspective view of an alternative embodiment of a sound altering patch in accordance with the present invention mounted to a cowbell.

Alternative embodiments of the patch may be adapted for use on percussion instruments other than drums. FIG. 5 illustrates an alternative embodiment of the patch 10' configured for use on a cowbell 40. The plastic material is cut in a rhombus shape to cover one side of the cowbell 40. The patch 10' has a slotted first portion 16' and unslotted second portion 18'. The slots 12 and the strips 14 separating the slots have similar dimensions and orientations to the marching snare drumhead patch 10. Application of the patch 10' will eliminate some of the ring of the bell. Additional playing surfaces are created on the side of the cow bell 40 covered by the patch. The slotted first portion 16' of the patch 10' may be used to create a guiro effect. The second portion 18' of the patch 10' presents a softer playing surface than the metal surface 42 of the cow bell 40, creating a softer impact sound when struck by a beater.

It should be understood that other combinations of materials and instruments are appropriate for use within the concept of the invention. Softer or harder materials may be used depending on the desired effect.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A marching snare drumhead patch for use in combination with a drumhead, said drumhead including a tensioned membrane having a uniform outwardly facing playing surface wherein said membrane emits sound producing vibrations when struck by a beater, said marching snare drumhead patch comprising:

a sheet of plastic material having a substantially continuous peripheral edge and including a first portion having a series of linear, substantially parallel laterally spaced apart slots extending inwardly from said peripheral edge and an adjacent, solid second portion, wherein said sheet is adherable to the playing surface of said membrane whereby said first portion of the sheet covers a first region of the playing surface such that the playing surface is exposed through said slots and said second portion of the sheet covers a second region of said playing surface, such that said playing surface is divided into at least three distinct playing areas.

2. The marching snare drumhead patch of claim 1, wherein said sheet is a semi-circle and said first portion occupies one half of said sheet and said second portion occupies the opposed half of said sheet.

3. The marching snare drumhead patch of claim 2, wherein said patch is laminated with a pressure sensitive adhesive.

4. The marching snare drumhead patch of claim 3, wherein said pressure sensitive adhesive layer has a thickness in the range of 0.001 to 0.003 inch.

5. The marching snare drumhead patch of claim 2, wherein said semi-circle is approximately seven inches in diameter.

6. The marching snare drumhead patch of claim 2, wherein each slot has a length, each slot having a substantially equal width measured perpendicular to said length, and separated by substantially equally wide strips of sheet material.

7. The marching snare drumhead patch of claim 6, wherein said slots have an orientation of approximately 55° to said diameter.

8. The marching snare drumhead patch of claim 6, wherein said slots have a width of approximately 3/16 inch and said strips have a width measured perpendicular to their longitudinal extent of approximately 1/8 inch.

9. The marching snare drumhead patch of claim 2, wherein said sheet is comprised of polycarbonate having a thickness in the range of 0.010 to 0.020 inch.

10. A sound altering patch for use on the playing surface of a percussion instrument, said patch comprising:

a sheet of material having top and bottom surfaces, said sheet including a first portion having a multiplicity of spaced openings distributed substantially uniformly over the entirety of one half of said sheet, and an adjacent solid second portion defining the other half of said sheet, and an adhesive layer on said bottom surface, said adhesive layer protected by a release liner.

11. The sound altering patch of claim 10, wherein said sheet is a plastic material having a semi-circular shape and said openings consist of a plurality of equally spaced, parallel slots, each said slot having a length and a substantially equal width measured perpendicular to said length.

12. The sound altering patch of claim 11, wherein said semi-circle has a diameter of approximately 7 inches and said slots are linear, have an angular orientation of approximately 55° to said diameter and have a width of approximately 3/16 inch and wherein said slots are separated by strips of approximately 1/8 inch of sheet material and originate approximately 3/16 inch from an edge of said semi-circular sheet.

13. The sound altering patch of claim 11, wherein said plastic material is polycarbonate and said top surface comprises a uniform texture.

14. The sound altering patch of claim 13, wherein said polycarbonate has a thickness in the range of 10 to 20 1/1000 inch and said adhesive layer has a thickness in the range of 1 to 3 1/1000 inch.

15. The sound altering patch of claim 10, wherein the openings are linear slots.

16. The sound altering patch of claim 15, wherein the slots have a width of about 3/16th inch.

17. The sound altering patch of claim 10, wherein the openings are slots, and the number of slots is about twelve.

18. A drumhead comprising:

a thin flexible sound producing membrane including an outwardly facing surface defining a first playing area, said membrane tensionable over an open end of a drum shell, wherein said membrane emits sound-producing vibrations when said surface is impacted with a drumstick, and a vibration altering layer of sheet material bonded to a region of said surface, said layer comprising a semi-circle having an approximately 7 inch diameter and including a first portion having a multiplicity of openings distributed uniformly thereon and an adjacent solid second portion, each said opening originating and terminating approximately 3/16 inch from a peripheral edge portion of said layer and having a substantially equal width of approximately 3/16 inch and separated from an adjacent opening by approximately 1/8 inch strips of layer material, said openings having an angular orientation of approximately 55° to said diameter, wherein said layer defines at least a second playing area having said openings and a third solid playing area, said first, second and third playing areas inducing musically distinct sound-producing vibrations of said membrane when struck by said drumstick, said second playing area producing a guiro sound when the drumstick is dragged thereacross.

19. The drumhead of claim 15, wherein said layer is comprised of polycarbonate and includes surfaces and second surfaces, said layer being laminated with a pressure sensitive adhesive layer on said second surface and said first surface having a generally uniform surface texture.

20. The drumhead of claim 19, wherein said polycarbonate has a thickness in the range of 10 to 20 1/1000 of an inch and said adhesive layer has a thickness in the range of 1 to 3 1/1000 of an inch.

21. The drumhead of claim 15, wherein the openings are a series of parallel, spaced apart slots.

22. The drumhead of claim 21, wherein the number of slots is about twelve.

* * * * *

UNITED STATES PATENT AND TRADEMARK OFFICE

CERTIFICATE OF CORRECTION

PATENT NO. : 6,291,753 B1
DATED : September 18, 2001
INVENTOR(S) : Campbell et al.

It is certified that error appears in the above-identified patent and that said Letters Patent is hereby corrected as shown below:

Column 5,
Line 37, after "distributed" delete "substantially".

Signed and Sealed this

Twenty-sixth Day of November, 2002

*Attest:*

*Attesting Officer*

JAMES E. ROGAN
*Director of the United States Patent and Trademark Office*